United States Patent [19]

Klos et al.

[11] Patent Number: 4,740,278

[45] Date of Patent: Apr. 26, 1988

[54] ACIDIC CHLORIDE CONTAINING BATH FOR THE ELECTRODEPOSITION OF ZINC/IRON ALLOYS

[75] Inventors: Klaus-Peter Klos; Karl-Heinz Lindemann; Hermann Donsbach, all of Trebur, Fed. Rep. of Germany

[73] Assignee: Elektro-Brite GmbH, Trebur/Industriegebiet, Fed. Rep. of Germany

[21] Appl. No.: 56,430

[22] Filed: May 29, 1987

[30] Foreign Application Priority Data

Jun. 9, 1986 [DE] Fed. Rep. of Germany ..... 3619384

[51] Int. Cl.[4] ..... C25D 3/56

[52] U.S. Cl. ..... 204/44.2

[58] Field of Search ..... 204/44.2, 44.5

[56] References Cited

U.S. PATENT DOCUMENTS

| | | | |
|---|---|---|---|
| 4,290,860 | 9/1981 | Matsudo et al. | 204/27 |
| 4,488,942 | 12/1984 | Martin et al. | 204/44.2 |
| 4,540,472 | 9/1985 | Johnson et al. | 204/28 |
| 4,541,903 | 9/1985 | Kyono et al. | 204/28 |
| 4,578,158 | 3/1986 | Kanamaru et al. | 204/44.2 |

FOREIGN PATENT DOCUMENTS

| | | | |
|---|---|---|---|
| 100284 | 9/1984 | Japan | 204/44.2 |

*Primary Examiner*—G. L. Kaplan

*Attorney, Agent, or Firm*—Kurt Kelman

[57] ABSTRACT

Bright electrodeposits of zinc/iron alloys of good ductility and adhesion are obtained at low electroplating voltage and high current yield by using a bath containing zinc chloride, ferrous chloride, conductive salt and, as additional ingredients, saccharin, a dextrin of molecular weight 2,000 to 30,000 and, optionally, a reducing agent for ferric ions such as alkali metal bisulfite, alkali metal dithionite and hydroxyl ammonium chloride at a $p_H$ 1–3.5.

2 Claims, No Drawings

ACIDIC CHLORIDE CONTAINING BATH FOR THE ELECTRODEPOSITION OF ZINC/IRON ALLOYS

The invention relates to an acidic chloride containing bath for the electrodeposition of zinc/iron alloys on to iron substrates.

From a lecture of K.Kyono et al "Development of Zn-Fe-alloy Electroplating with a soluble Anode in chloride Bath" at Fourth continuous strip plating symposium of American Electroplater's Society, Inc., Chicago, 1st to 3rd May 1984, it is known to produce electrodeposits of zinc/iron alloys onto iron, e.g. car body steel sheet, from acidic chloride containing baths containing 100 gs/liter of ferrous chloride, 220 gs/liter of zinc chloride and 300 gs/liter of ammonium chloride and 150 to 350 gs/liter of potassium chloride, respectively, at a $p_H$ of 3 and a temperature of 50° C. using a current density of 25 to 150 Amps/dm$^2$, the bath containing iron and zinc in an amount depending from the current density and the weight ratio $Fe^{2+}/(Fe^{2+}+Zn^{2+})$.

Although in such a bath the iron content of the alloy is not as much dependent from the current density as in the case of similar sulfate containing baths that have an iron content in the alloy deposit varying from 10 percent by weight at 30 Amps/dm$^2$ to 45 percent by weight at 30 Amps/dm$^2$ and reaches 62 percent by weight at 120 Amps/dm$^2$ the electrodeposits lack of brightness if deposited at normal current densities of about 50 Amps/dm$^2$. For this reason they are used as basic corrosion protective layers onto which laquers are electrodeposited or coated by different means, optionally after phosphatizing the substrate.

Finally the electrodeposits obtained according to the known process are of low ductility and the adhesive power gives cause to objections. Frequently the formation of craters is seen on the electrodeposits.

Object of the invention is to provide a bath for electrodepositing zinc/iron alloys that avoids these aforementioned disadvantages, and, in addition, allows improvements, such as lowering of the deposit voltage and increasing the current yield.

It has been found that surprisingly zinc/iron alloy electrodeposits onto iron substrates are obtained by using a bath containing 1 to 3 moles/liter of zinc chloride, 0.2 to 2 moles/liter of ferrous chloride, 1 to 5 moles/liter of conductive salt as well as further additives at a $p_H$ of 1 to 3.5, the bath being characterised in that as further additives 0.01 to 1.5 gs/liter of saccharin and/or 0.01 to 1.5 gs/liter of a dextrin of molecular weight 2,000 to 30,000 and optionally 0.01 to 2 gs/liter of a reducing agent for $Fe^{3+}$ selected from the group consisting of Alkali Sulfite, Alkali dithionite and Hydroxylammonium chloride are present.

Preferred as conductive salts are the chlorides of sodium, potassium and ammonium, respectively. The $p_H$ of the bath is prefer-ably adjusted to $p_H$3.0 by means of hydrochloric acid or a solution of the hyroxides of sodium, potassium and ammonium, respectively.

Whereas in the bath of the invention the content of saccharin is mainly responsible for the brightness to the elctrodeposits ductility and adhesion of the deposit. Dextrin acts as a brightening agent as well as a softening agent.

By the reducing agent that is used according to the practical needs the current yield is increased; the current yield is lowered by an increasing numer of $Fe^{3+}$-ions and this number is lowered in the bath by reducing $Fe^{3+}$-ions to $Fe^{2+}$-ions.

The invention is illustrated by the following examples:

The following basic bath was used in the examples:

$ZnCl_2$; 245 gs/l (1.79 moles/l)

$FeCl_2$ 2 $H_2O$; 86 gs/l (0.53 moles/l)

KCl; 300 gs/l (4.02 moles/l).

The ingredients were solved in distilled water up to about 900 cm$^3$ followed by the addition of the constituents of the Examples I and II and finally filled up to 1 liter with distilled water. Steel strips measuring 2 cm in width and 2 mm thickness were electrocoated with a zinc/iron alloy coating at a current density of 75 A/dm$^2$, the strips being continuously moved through the bath as a cathode with a speed of 20 m/min. The bath temperature was 30° C.

EXAMPLE I

Basic bath

Additives:

0.2 gs/l saccharin 0.5 gs/l dextrin.

Result:

Bright very strong and well adhering deposit of zinc/Fe with about 20% b.w. Fe.

EXAMPLE II

Basic bath

Additives:

1.0 gs/l saccharin 1.2 gs/l dextrin 0.1 gs/l sodium bisulfite.

Result:

Bright strong and ductile well adhering deposit of Zn/Fe of about 5% b.w. Fe.

We claim:

1. An acidic chloride containing zinc and iron containing bath for the electrodeposition of lustrous zinc/iron alloy coatings onto iron containing 1 to 3 moles/l of zinc chloride and 0.2 to 2 moles/l of ferrous chloride, 1 to 5 moles/liter of a conductive salt, having a $p_H$ of 1 to 3.5 and containing further additives characterised in that it contains as further additives 0.01 to 1.5 gs/l of saccharin, in addition or in place of the saccharin 0.01 to 1.5 gs/l of dextrin having a molecular weight of 2,000 to 30,000 and, optionally, 0.01 to 2 gs/l of a reducing agent for $Fe^{3+}$ selected from the group consisting of alkali metal bisulfate, alkali metal dithionite and hydroxy ammonium chloride.

2. Zinc and iron containing bath as claimed in claim 1 characterised in that it contains the chlorides of sodium, potassium and ammonium, respectively, as conductive salts.

* * * * *